US008341888B2

(12) United States Patent
Stull

(10) Patent No.: US 8,341,888 B2
(45) Date of Patent: Jan. 1, 2013

(54) ENCLOSED POWERED GATE POST

(75) Inventor: Edward J. Stull, Oxford, MI (US)

(73) Assignee: Turnstyle Intellectual Property, LLC, Georgetown, SC (US)

( * ) Notice: Subject to any disclaimer, the term of this patent is extended or adjusted under 35 U.S.C. 154(b) by 0 days.

(21) Appl. No.: 13/055,168

(22) PCT Filed: Jul. 23, 2009

(86) PCT No.: PCT/US2009/051494
§ 371 (c)(1),
(2), (4) Date: Apr. 26, 2011

(87) PCT Pub. No.: WO2010/011810
PCT Pub. Date: Jan. 28, 2010

(65) Prior Publication Data

US 2011/0193041 A1 Aug. 11, 2011

Related U.S. Application Data

(60) Provisional application No. 61/082,959, filed on Jul. 23, 2008.

(51) Int. Cl.
*E06B 11/02* (2006.01)
*E05F 15/12* (2006.01)

(52) U.S. Cl. ..... 49/237; 49/334; 49/339

(58) Field of Classification Search ..... 49/333, 49/334, 336, 324, 381, 236, 237, 238; 256/73
See application file for complete search history.

(56) References Cited

U.S. PATENT DOCUMENTS

| | | | | |
|---|---|---|---|---|
| 363,964 | A | 5/1887 | Philpott | |
| 1,594,260 | A * | 7/1926 | Herr | 49/46 |
| 4,168,054 | A * | 9/1979 | Weiland | 256/73 |
| 4,290,344 | A * | 9/1981 | Adams | 91/467 |
| 4,472,908 | A * | 9/1984 | Wanzl et al. | 49/25 |
| 4,651,969 | A * | 3/1987 | Dowdall | 251/14 |
| 4,665,650 | A * | 5/1987 | Hall | 49/334 |
| 5,050,344 | A * | 9/1991 | Skeem | 49/237 |
| 5,133,152 | A * | 7/1992 | Grancagnolo | 49/239 |
| 5,138,796 | A * | 8/1992 | Grainger | 49/238 |
| 5,299,387 | A * | 4/1994 | Miller et al. | 49/28 |
| 5,373,664 | A * | 12/1994 | Butler | 49/358 |

(Continued)

FOREIGN PATENT DOCUMENTS

JP 8-326338 12/1996

(Continued)

OTHER PUBLICATIONS

International Preliminary Report on Patentability mailed on Feb. 3, 2011 for Application No. PCT/US2009/051494.

(Continued)

*Primary Examiner* — Katherine W Mitchell
*Assistant Examiner* — Justin Rephann
(74) *Attorney, Agent, or Firm* — Carlson, Gaskey & Olds PC

(57) ABSTRACT

A powered post assembly includes an enclosed actuator that supports rotation of a gate. An outer tube defines a hollow interior space. A fixed post and a rotating post are both disposed within the oval tube. The actuator is mounted within the fixed post and drives rotation of the rotating post. Because the actuator is disposed within the fixed tube, it is sheltered from the elements and from undesired tampering.

19 Claims, 5 Drawing Sheets

U.S. PATENT DOCUMENTS

| | | | | |
|---|---|---|---|---|
| 5,593,141 | A * | 1/1997 | Cain et al. | 256/26 |
| 5,615,520 | A * | 4/1997 | McGuire | 49/237 |
| 6,904,642 | B2 * | 6/2005 | West | 16/50 |
| 7,155,779 | B2 * | 1/2007 | Watkins | 16/316 |
| 7,404,532 | B1 * | 7/2008 | Baril | 248/218.4 |
| 2005/0156149 | A1 * | 7/2005 | Stull | 256/73 |
| 2007/0221904 | A1 * | 9/2007 | Stull | 256/73 |
| 2007/0235151 | A1 * | 10/2007 | Stull | 160/351 |
| 2008/0127556 | A1 * | 6/2008 | Trujillo et al. | 49/28 |
| 2008/0237561 | A1 * | 10/2008 | Cozby | 256/73 |
| 2008/0307709 | A1 * | 12/2008 | Stull | 49/280 |

FOREIGN PATENT DOCUMENTS

| | | |
|---|---|---|
| JP | 9-273361 | 10/1997 |
| JP | 2001-262946 | 9/2001 |
| JP | 2006-45819 | 2/2006 |

OTHER PUBLICATIONS

International Search Report and Written Opinion mailed on Feb. 17, 2010 for Application No. PCT/US2009/051494.

* cited by examiner

ENCLOSED POWERED GATE POST

CROSS REFERENCE TO RELATED APPLICATION

This application claims priority to U.S. Provisional Application No. 61/082,959 which was filed on Jul. 23, 2008.

BACKGROUND

This disclosure generally relates to an automatic gate opener. More particularly, this disclosure relates to a powered gate post for opening a gate assembly.

An automatic gate typically includes an articulated arm attached to a motor mounted external and apart from a gate. The motor drives the articulated arm to rotate the gate between open and closed positions. The articulated arm is exposed and susceptible to accidental and intentional damage. Accordingly, it is desirable to design and develop an automatic gate opening device that is not susceptible to such damage.

SUMMARY

A disclosed example powered gate assembly includes a powered post assembly with an enclosed actuator that supports rotation of a gate assembly. The powered post assembly includes an outer tube that defines a hollow interior space. Slots are provided in the outer tube through which extend corresponding threaded rods. The threaded rods provide a mounting location for the gate assembly. The actuator is mounted within a fixed post and moves a rotatable post supported on the fixed post.

The fixed post and the rotating post are both disposed within the oval tube. The actuator mounted within the fixed post drives a drive pin. The drive pin extends through a drive slot in the fixed post and extends into a drive channel within the rotating post. The drive slot includes a shape that translates vertical movement into rotational movement. The rotational movement is translated through the drive pin to the driven channel to rotate the rotating post within the outer post.

Because the actuator is disposed within the fixed post, it is sheltered from the elements and from undesired tampering. The rotating post is supported on the fixed post through a bearing assembly disposed along the axis.

Accordingly, the disclosed example gate assembly includes features that provide for the automatic opening and closing while concealing and protecting the drive mechanism and actuator from the elements or undesired tampering.

DETAILED DESCRIPTION OF THE PREFERRED EMBODIMENT

Figure 1:
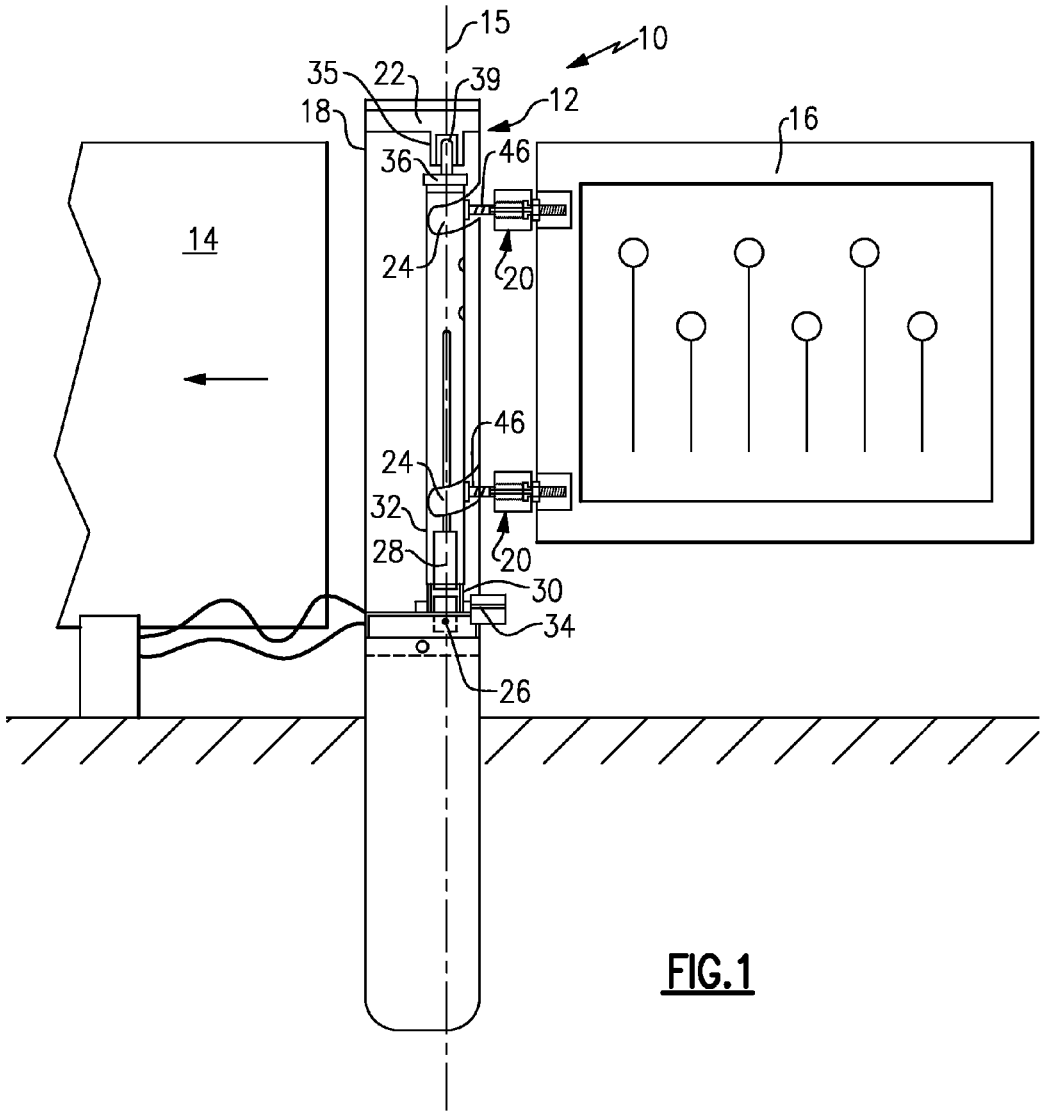
FIG. 1 is a schematic view of an example powered gate post assembly.
Figure 2:
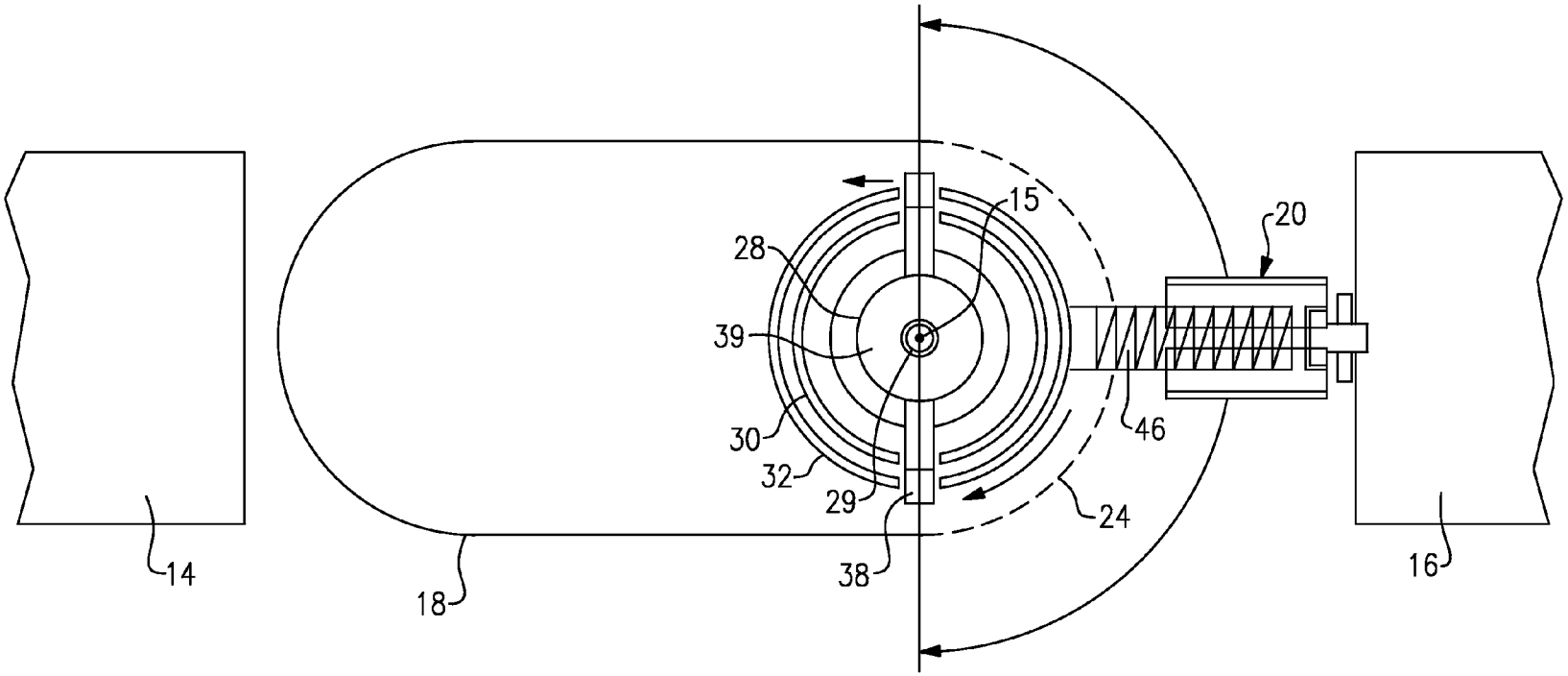
FIG. 2 is a top view of the example powered gate post assembly.

Referring to FIGS. 1 and 2, an example powered gate assembly 10 includes a powered post assembly 12 that supports rotation of a gate assembly 16. The powered post assembly 12 is mounted within the ground or other surface and is attachable to a fence 14.

The powered post assembly 12 includes an outer tube 18 that is installable within the ground and that defines a hollow interior space. Slots 24 are provided in the outer tube 18 through which extend corresponding threaded rods 46. The threaded rods 46 provide a mounting location for fastening assemblies 20 that are attached to the gate assembly 16. The threaded rods 46 are moved within the slots 24 about an axis 15 to move the gate assembly 16. The threaded rods 46 are fixed to a rotating post 32 supported on a fixed post 30 within the outer tube 18. The actuator 28 moves the rotatable post 32 through a drive mechanism disposed within the fixed post 30.

The fixed post 30 and the rotating post 32 are both disposed within the oval tube 18. The fixed post 30 is rotationally fixed by a clamp 34 supported on a base plate 26. The clamp 34 fixes the rotational position of the fixed post 30 in a desired position so that the gate assembly position is as desired. Adjustment of the gate assembly position can be changed by unclamping the clamp 34, rotating the fixed post 30 to the desired position, and reengaging the clamp 34 to maintain the desired position.

The slots 24 in the oval tube 18 are of such a length about the oval outer tube 18 such that a desired amount of gate swing or opening angle is provided. In the example, the slots 34 provide approximately 180 degrees of gate swing. As appreciated, the size and length of the slots 24 can be tailored to accommodate the desired amount of gate swing. Accordingly, the example gate assembly can be opened in any direction as is provided by the length of the slots 24, A cap 22 is provided at the top of the outer tube 18 and engages a top guide 36 that is mounted on the rotating post 32. The cap 22 increases structural rigidity of the outer tube 18 and includes a sleeve 35 that receives a guide post 39 of a top guide 36 mounted to the rotating post 32. The interface between the top guide 36 and the sleeve 35 of the cap 22 provides a rigid support structure that maintains spacing between the fixed outer tube 18 and the rotating post 32. Maintaining spacing between the outer tube 18 and the rotating post 32 therein maintains the spacing of the threaded rods 46 as they move within the slots 24.

The actuator 28 is mounted within the fixed post 30 and drives a threaded drive shaft 29. A drive pin 38 is attached to a driven member 39 that is in threading engagement with the threaded drive shaft 29. Rotation of the threaded drive shaft 29 generates linear movement of the driven member 39 and thereby the drive pin 38. The drive pin 38 guides within a drive slot 40 of the fixed post 30. The drive slot 40 includes a shape that translates the linear movement of the drive pins 38 into rotational movement. The example drive slot 40 includes an arcuate shape that provides for swinging of the gate assembly 16 in both directions. In other words, the drive slot 40 includes a profile that drives rotation of the gate assembly 16 in a first direction when the drive pin 38 is driven vertically upward and in a second direction opposite from the first direction when the drive pin 38 is driven vertically downward. A middle position moves the gate assembly to a closed or home position. This provides a 180 degree swing opening of the gate assembly 16. The swing of the gate assembly 16 between a closed position and an open position can be tailored to the desired application by modifying the shape and length of the drive slot 40.

The drive pin 38 extends through the drive slot 40 into a driven channel 44 within the rotating post 32. The drive channel 44 is straight such that rotational movement of the drive pin 38 causes rotation of the rotating post 32 relative to both the fixed post 30 and the outer post 18.

The example actuator 28 rotates the drive shaft 29 about the axis 15 causing vertical movement of the driven member 39. The drive slot 40 includes an arcuate shape in the vertical direction that drives rotation of the drive pins 38 about the axis 15. The rotation generated by the drive slot is transferred to the driven channels 44 in the rotating post 32. Although a rotary motor is utilized as the example actuator, other actuators that produce linear movement are also within the contemplation of this invention.

Figure 3:
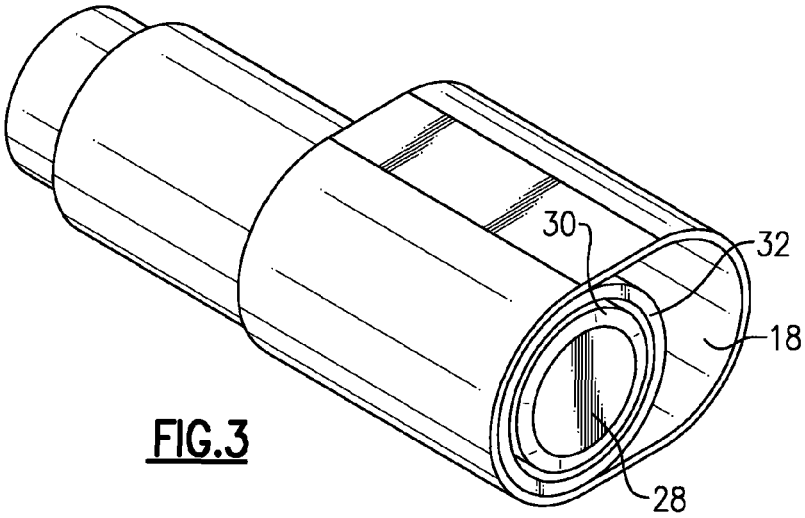
FIG. 3 is a perspective view of a portion of the example powered gate post assembly.

Referring to FIG. 3 with continuing reference to FIGS. 1 and 2, the actuator 28 is disposed entirely within the fixed tube 30. The rotating post 32 is disposed about and rotates relative to the fixed tube 30. Because the actuator 28 is disposed within the fixed tube 30, it is sheltered from the elements and from undesired tampering. The actuator 28 is an electric motor and receives electric power from an outside power source such as alternating current, or may be powered using a direct current power supply such as a battery. The relatively compact nature of the example actuator is feasible only because of the structure of the example power post assembly 12 as will be discussed below.

Figure 4:
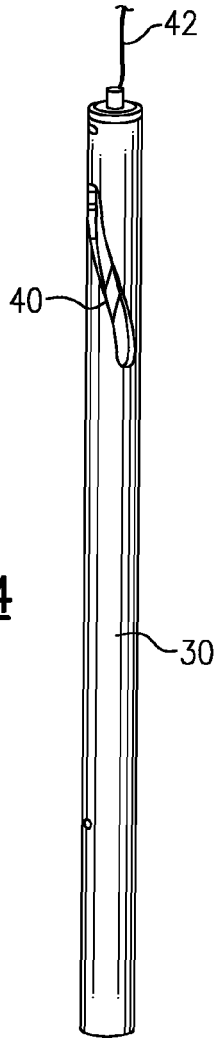
FIG. 4 is a view of an inner fixed post.
Figure 6:
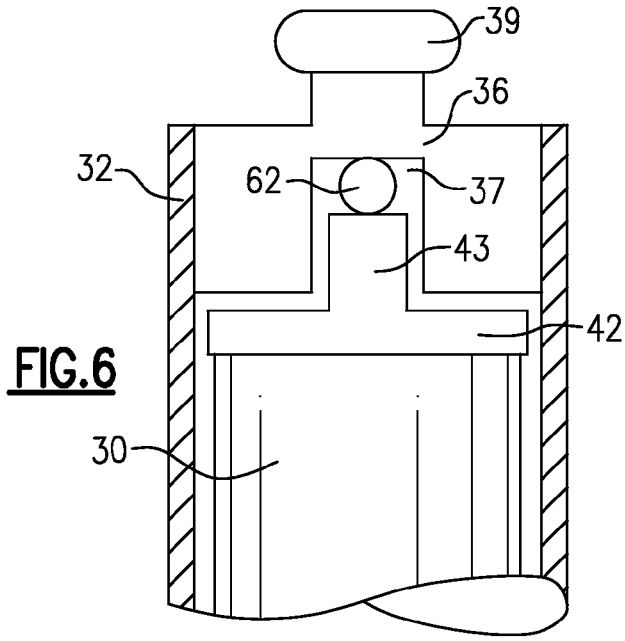
FIG. 6 is a schematic view of the interface between the inner fixed post and the outer rotating post.
Figure 5:
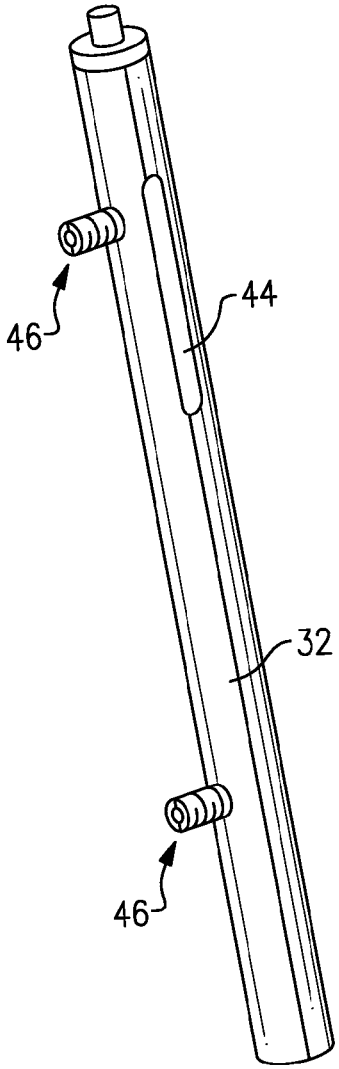
FIG. 5 is a view of an outer rotating post.

Referring to FIGS. 4, 5 and 6 with continued reference to FIGS. 1 and 2, the rotating post 32 is supported on the fixed post 30 through a bearing assembly disposed along the axis 15. The fixed post 30 includes a top cap 42 that supports a single ball bearing 62. The cap 42 includes a support post 43 on which the ball bearing 62 rests. The top guide 36 includes a sleeve or cavity 37 that receives the ball bearing 62 and a portion of the post 43. The weight of the gate assembly 16 and the rotating post 32 are supported at the interface between the single ball bearing 62 and the post 43. The ball bearing 62 substantially reduces frictional forces generated by the weight of the gate assembly 16. Moreover, the bearing 62 is supported along the axis of rotation 15 that further supports the load along the fixed post 30 and the outer tube 18 to reduce forces required to rotate the gate assembly 16. This results in the ability to utilize motors of reduced size as compared to conventional devices utilized for opening and closing a gate assembly 16.

The example cap 42 and top guide 36 include the post 43 supported on the fixed post 30 and the cavity 37 defined within the top guide 36 of the rotating post 32. However, the features could be reversed such that the cap 42 includes the cavity and the top guide includes the post with the single ball bearing 62 disposed there between.

The top guide 36 includes the guide post 39 that is received within the sleeve 35 of the top 22. The guide post 39 includes a semi-spherical shape that accommodates some movement and mis-alignment between the rotating post 32 and the outer tube 18. Moreover, the shape of the guide post 39 accommodates relative movement between the rotating post 32 and the outer post 18 while maintaining the desired spacing therebetween.

The fixed post 30 includes a drive slot 40 within which the drive pin 38 guides. The example drive slot 40 is curved to produce rotary motion responsive to vertical movement of the drive pins 38. The rotating post 32 includes the driven channel 44 that is also engaged with the drive pins 38. Vertical movement of the drive pins 38 caused by the actuator 28 produces a rotary motion due to the shape of the drive slot 40. The fixed post 30 does not rotate, but the rotating tube 30 that is also engaged to the drive pins 38 is free to rotate and does due to the support on the ball bearing 62.

Figure 7:
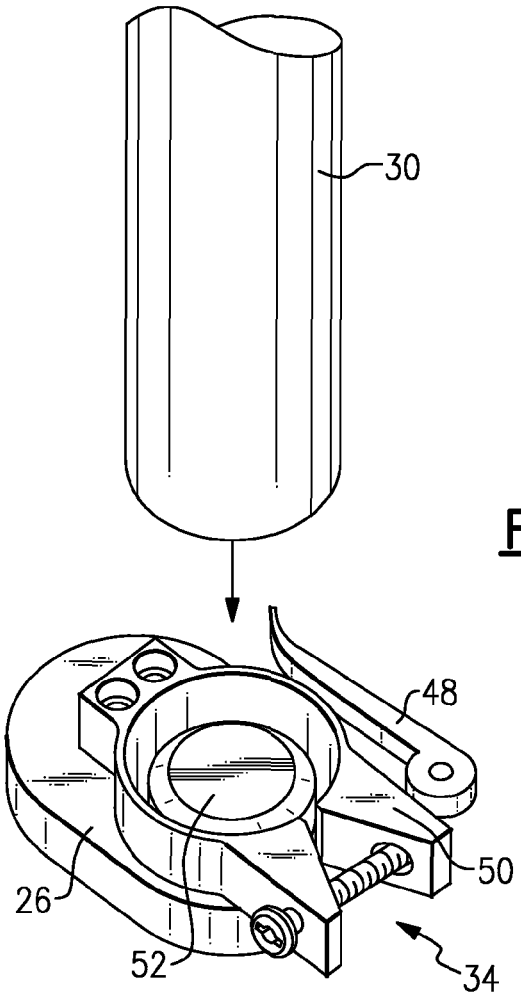
FIG. 7 is a base and clamp assembly for securing the inner fixed post.

Referring to FIG. 7, with continued reference to FIG. 1, the example clamp assembly 34 includes the base 26 that is mounted within the oval tube 18. The base 26 includes a guide 52 for receiving the fixed tube 30. The fixed tube 30 is secured to prevent rotation by the clamp 50. The clamp 50 is compressed around the fixed tube 30 by a handle 48. The clamping force applied sufficiently secures the fixed tube 30 to maintain a desired alignment and prevent rotation. However, the clamp assembly 34 is not a permanent mounting and provides for rotation of the fixed tube 30 in the event that an overwhelming force is encountered. In other words, during normal operation the clamp 34 prevents rotation of the fixed tube 30. However, should an overwhelming force be encountered the clamping force provided by the clamp 34 can be overcome and allow rotation of the fixed tube 30 to prevent damage to assembly 12. The give provided by the clamp 34 protects the actuator and other parts from damage caused by excessive force on the gate 16.

Figure 8:
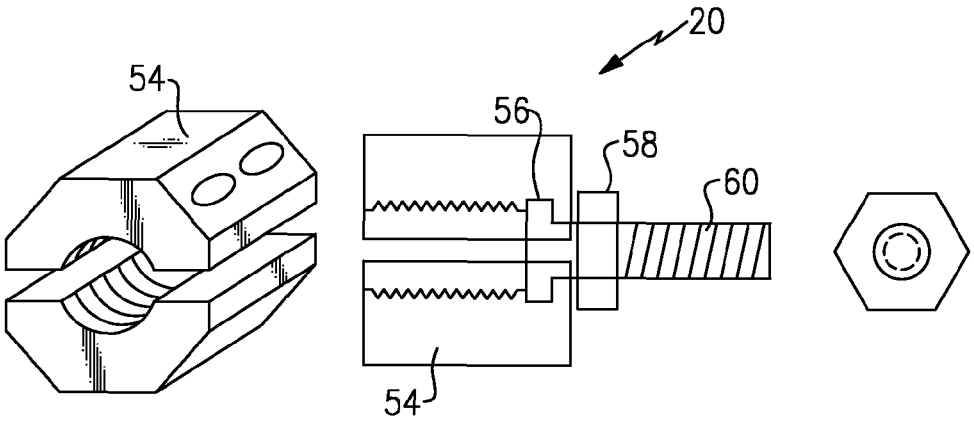
FIG. 8 is an example fastening assembly for securing a gate to the powered gate post.

Referring to FIG. 8, the example fastening assembly 20 includes threaded portion 60 that is received within the gate 16. A hex portion 58 is utilized to tighten the threaded portion 60 into the gate 16. A cap 56 is an integral part of the threaded portion and fits within a clamp 54. The clamp 54 includes internal threads that receive the threaded rods 46 affixed to the rotating post 32. The clamp 54 is rotatable relative to the threaded portion 60 to provide adjustment of a distance between the outer post 18 and the gate 16. Once a desired position is obtained, fasteners such as screws are tightened to compress the clamp 54 around the threaded rod 46 to maintain the desired alignment.

Accordingly, the disclosed example gate assembly 16 includes features that provide for the automatic opening and closing while concealing and protecting the drive mechanism and actuator from the elements or undesired tampering.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A powered post assembly for moving a gate assembly comprising:

an outer post defining an internal space and including at least one opening;

a rotating post disposed within the outer post, the outer post including a fastening member extending through the at least one opening, wherein the fastening member is attachable to support a gate assembly;

a fixed post supporting rotation of the rotating post within the outer post; and an actuator driving the rotating post and the fastening member relative to the fixed post and the outer post, wherein the fixed post comprises a drive slot and the actuator moves a drive pin within the drive slot, the drive pin extending through the drive slot and into driving contact with the rotating post for moving the rotating post within the outer post.

2. The powered post assembly as recited in claim 1, including a bearing assembly supporting the rotating post on the fixed post, wherein the bearing structure includes a single ball bearing centered along an axis of rotation of the outer post.

3. The powered post assembly as recited in claim 2, including a support supported on one of the fixed post and the rotating post and a sleeve disposed about the support with the single ball bearing disposed between the support and the sleeve.

4. The powered post assembly as recited in claim 1, wherein the rotating post includes a driven slot within which the drive pin guides for rotating the rotating post.

5. The powered post assembly as recited in claim 4, wherein the actuator moves the drive pin linearly within the drive slot, the drive slot including a shape translating linear movement to rotary movement such that linear movement, and the driven slot comprises a straight opening corresponding to the linear movement of the drive pin.

6. The powered post assembly as recited in claim 1, wherein the fastening member comprise at least two fastening members and the at least one opening in the outer post comprises at least two slots through which a corresponding one of the fastening members extends.

7. The powered post assembly as recited in claim 6, wherein the fastening members comprise threaded rods to which a gate assembly is attachable.

8. The powered post assembly as recited in claim 7, including an adaptor attachable between the fastening members and the gate assembly, the adaptor adjustable to vary a distance between the gate assembly and the outer post.

9. The powered post assembly as recited in claim, including a base plate supported within the outer post for supporting the fixed post, the base plate including an outer shape corresponding to the internal space of the outer post and a clamp for securing the fixed post.

10. A power actuated gate assembly comprising:

an outer post defining an internal space and including an opening for a movable attachment member;

a fixed post supported within the internal space;

a rotating post supported for rotation relative to the fixed post, wherein the attachment member is fixed to the rotating post;

an actuator disposed within the fixed post for driving rotation of the rotation post; and a gate assembly attachable to the attachment member, wherein the fixed post includes a slot, the rotating post includes a driven channel, and the actuator drives a drive pin that extends through the driven slot into the drive channel.

11. The power actuated gate assembly as recited in claim 10, wherein the outer post comprises an oval shaped cross-section and the fixed post and the rotating post comprise circular shaped cross-sections.

12. The power actuated gate assembly as recited in claim 10, wherein the gate assembly is movable through an operating range of 180 degrees.

13. The power actuated gate assembly as recited in claim 10, including a bearing assembly supporting the rotating post on the fixed post, wherein the bearing structure includes a single ball bearing centered along an axis of rotation of the outer post that is supported on a fixed post disposed on one of the fixed post and the rotating post and a sleeve disposed about the fixed post and the single ball bearing such that the single ball bearing is disposed between the post and the sleeve.

14. The power actuated gate assembly as recited in claim 13, wherein the actuator comprises a motor rotating a threaded shaft with a driven member movable linearly along the threaded shaft responsive to rotation of the threaded shaft, the driven member driving the drive pin linearly.

15. The power actuated gate assembly as recited in claim 13, wherein the opening in the outer post comprise at least two slots and the attachment member comprises a threaded member extending through a corresponding one of the at least two slots.

16. The power actuated gate assembly as recited in claim 15, including an adaptor for attachment one a first end to the gate assembly and on a second end to the threaded member extending through one of the at least two slots, the adaptor including an adjustment structure for setting a distance between the gate assembly and the outer post.

17. The power actuated gate assembly as recited in claim 16, wherein the adaptor includes a threaded portion and a clamp portion, the threaded portion attachable to the gate assembly and the clamp portion attachable to the threaded member.

18. A power actuated gate assembly comprising:

an outer post defining an internal space and including an opening for a movable attachment member;

a fixed post supported within the internal space;

a rotating post supported for rotation relative to the fixed post, wherein the attachment member is fixed to the rotating post;

an actuator disposed within the fixed post for driving rotation of the rotation post; and a gate assembly attachable to the attachment member, including a support base disposed within the outer post for supporting the fixed post, the support base including a clamp for holding the fixed post in a desired position, the clamp releasable for adjusting a rotational position of the fixed post within the outer post.

19. The power actuated gate assembly as recited in claim 18, wherein the outer post comprises an oval shaped cross-section and the fixed post and the rotating post comprise circular shaped cross-sections.

* * * * *